US006085474A

United States Patent [19]

Mizuno

[11] Patent Number: 6,085,474

[45] Date of Patent: Jul. 11, 2000

[54] DEVICE FOR MINIMIZING EARTHQUAKE SHOCKS TO A SMALL BUILDING

[76] Inventor: Tsutomu Mizuno, 362, Kijoshinden, Sagara-cho, Haibara-gun, Shizuoka-ken, Japan

[21] Appl. No.: 09/197,877

[22] Filed: Nov. 23, 1998

[30] Foreign Application Priority Data

Mar. 16, 1998 [JP] Japan ..... 10-088117

[51] Int. Cl.[7] ..... E04B 1/98

[52] U.S. Cl. ..... 52/167.5; 52/167.1; 52/167.4; 52/167.7

[58] Field of Search ..... 52/167.1, 167.4, 52/167.5, 167.7, 167.9

[56] References Cited

U.S. PATENT DOCUMENTS

| | | | |
|---|---|---|---|
| 845,046 | 2/1907 | Bechtold | 52/167.5 |
| 932,443 | 8/1909 | Calantarients | 52/167.4 |
| 1,615,350 | 1/1927 | Tambone | 52/167.4 |
| 2,221,193 | 11/1940 | Kastner | 52/167.1 |
| 3,349,418 | 10/1967 | Hein | 52/167.7 X |
| 5,261,200 | 11/1993 | Sasaki et al. | 52/167.5 |
| 5,564,237 | 10/1996 | Yoneda | 52/167.5 |

*Primary Examiner*—Beth A. Stephan
*Assistant Examiner*—Brian E. Glessner
*Attorney, Agent, or Firm*—Harrison & Egbert

[57] ABSTRACT

An inexpensive device for minimizing earthquake shocks to a small building. A foundation of the building is divided into an upper foundation and a lower foundation. Grains of sand are rollably disposed between the upper foundation and the lower foundation. The grains of sand support the weight of the building including the upper foundation. The building is not moved in a horizontal direction by a small force of wind, etc.

4 Claims, 5 Drawing Sheets

DEVICE FOR MINIMIZING EARTHQUAKE SHOCKS TO A SMALL BUILDING

BACKGROUND OF THE INVENTION (1) Field of the Invention

The present invention relates to a device for minimizing earthquake shocks to a small building. More particularly, the invention relates to a seismic isolation device or a base isolation device for minimizing earthquake shocks to a small building such as a wooden house and a small steel-frame house.

(2) Description of the Prior Art

A conventional device for minimizing earthquake shocks to a small building comprises a foundation of the building being divided into an upper foundation and a lower foundation, perfect spherical bodies, such as steel balls and concrete balls, being rollably disposed between the upper foundation and the lower foundation, the perfect spherical bodies supporting the weight of the building including the upper foundation.

However, the above-mentioned device for minimizing earthquake shocks to a small building has the following disadvantages:

(i) The perfect spherical bodies have a very small coefficient of rolling friction. When the perfect spherical bodies are disposed between the upper foundation and the lower foundation, the building including the upper foundation is sensitively moved even by a small force of wind, etc. Therefore, a trigger device and a damping device are necessary.

(ii) Since the perfect spherical bodies are very easily rolled, it is necessary to maintain the perfect spherical bodies in place by a precise means.

(iii) Since the spherical bodies, such as concrete balls, cannot bear a large load, it is not possible to increase the weight per unit area of the building beyond a certain limit.

(iv) Since the spherical bodies, such as steel balls, do not have satisfactory durability and weatherproofness, they cannot be used for a long period of time.

SUMMARY OF THE INVENTION

It is therefore an object of the invention to provide a device for minimizing earthquake shocks to a small building, which device has obviated all the disadvantages of the prior art.

It is another object of the invention to provide a device which minimizes horizontal shocks of an earthquake to the small building.

It is a further object of the invention to provide a device for minimizing earthquake shocks to a small building, which device is simple and inexpensive.

It is a further object of the invention to provide a device for minimizing earthquake shocks to a small building, which device can prevent the small building from being moved in a horizontal direction by a small force of wind.

It is a further object of the invention to provide an device for minimizing earthquake shocks to a small building, which device has satisfactory weatherproofness and can be used for a long period of time.

These and other objects have been attained by a device for minimizing earthquake shocks to a small building, which device comprises a foundation of the building being divided into an upper foundation and a lower foundation, grains of sand being rollably disposed between the upper foundation and the lower foundation, the grains of sand supporting the weight of the building including the upper foundation.

The grains of sand may be replaced by nonspherical particles having rough surfaces.

Alternatively, the device for minimizing earthquake shocks to a small building may comprise grains of sand being rollably disposed between a groundsill of a building and a foundation of the building, the grains of sand supporting the weight of the building including the groundsill.

The grains of sand rollably disposed between the groundsill of the building and the foundation of the building may be replaced by nonspherical particles having rough surfaces.

The grains of sand or the nonspherical particles having rough surfaces may be placed between an elastic upper holding plate and an elastic lower holding plate, the upper holding plate being fixed to a lower surface of the upper foundation or a lower surface of the groundsill, the lower holding plate being fixed to an upper surface of the lower foundation or an upper surface of the foundation.

The upper holding plate and the lower holding plate may respectively have a rigid core in the inside.

The operation of the device for minimizing earthquake shocks to a small building according to the present invention will now be described.

In the device in which grains of sand are rollably disposed between the upper foundation and the lower foundation, the weight of the building including the upper foundation is always supported by the grains of sand. The upper foundation does not contact the lower foundation. Grains of sand are nonspherical particles having rough surfaces and various shapes. Therefore, grains of sand have a coefficient of rolling friction much larger than the that of spherical bodies. The grains of sand disposed between the upper foundation and the lower foundation do not roll when the building receives a small horizontal force of wind. Thus, the building including the upper foundation is not moved in a horizontal direction by a small force of wind. When the ground on which the lower foundation is fixed is shaken or trembled by an earthquake, the grains of sand rollably disposed between the upper foundation and the lower foundation are rolled so as to minimize horizontal shocks of the earthquake to the building including the upper foundation. Thus, the building is protected from the horizontal shocks of the earthquake.

In the device in which nonspherical particles having rough surfaces are rollably disposed between the upper foundation and the lower foundation, the nonspherical particles function in the same manner as the grains of sand.

In the device in which grains of sand are rollably disposed between a groundsill of the building and a foundation of the building, the weight of the building including the groundsill is always supported by the grains of sand. The groundsill does not contact the foundation. As mentioned above, grains of sand have a coefficient of rolling friction much larger than the that of spherical bodies. The grains of sand disposed between the groundsill and the foundation do not roll when the building receives a small horizontal force of wind. Thus, the building including the groundsill is not moved in a horizontal direction by a small force of wind. When the ground on which the foundation is fixed is shaken or trembled by an earthquake, the grains of sand rollably disposed between the groundsill and the foundation are rolled so as to minimize horizontal shocks of the earthquake to the building including the groundsill. Thus, the building is protected from the horizontal shocks of the earthquake.

In the device in which nonspherical particles having rough surfaces are rollably disposed between the groundsill and the foundation, the nonspherical particles function in the same manner as the grains of sand.

In the device in which the grains of sand or the nonspherical particles having rough surfaces are placed between an elastic upper holding plate and an elastic lower holding plate, the grains of sand or the nonspherical particles cut into the upper and lower holding plates according to the sizes and shapes thereof. Even if the grains of sand or the nonspherical particles have different sizes and shapes, the weight of the building is supported by almost all of the grains of sand or the nonspherical particles. Therefore, the grains of sand or the nonspherical particles can bear a larger load.

Since the grains of sand or the nonspherical particles cut into the upper and lower holding plates, the grains of sand or the nonspherical particles are likely to roll and unlikely to slide between the upper and lower holding plates. Therefore, the coefficient of friction between the grains of sand or the nonspherical particles and the upper and lower holding plates is relatively small, and the difference between the coefficient of statical friction and the coefficient of dynamical friction is small.

As a result, the building is not moved in a horizontal direction by a small horizontal force of wind, etc., and horizontal shocks of the earthquake are not transmitted to the building. Thus, the building is more effectively protected from the horizontal shocks of the earthquake.

In the device in which the elastic upper holding plate and the elastic lower holding plate respectively have a rigid core in the inside, portions of each holding plate above and below the rigid core have elasticity. Therefore, even if the lower surface of the upper foundation or the groundsill or the upper surface of the lower foundation or the foundation is not precisely finished, all portions of each rigid core receive a uniform force. Also, a portion of the upper holding plate below the rigid core thereof and a portion of the lower holding plate above the rigid core thereof, both of which portions contact the grains of sand or the nonspherical particles, are kept flat. As a result, the grains of sand or the nonspherical particles receive a uniform force and function uniformly.

DETAILED DESCRIPTION OF THE INVENTION

The present invention will now be described in detail with reference to the attached drawings.

In embodiments shown in FIGS. 1 to 6, a foundation 1 of a building is divided into an upper foundation 1*a* and a lower foundation 1*b*. Grains of sand 3 are rollably disposed between the upper foundation 1*a* and the lower foundation 1*b*. The grains of sand 3 support the weight of the building including the upper foundation 1*a*.

Figure 8:
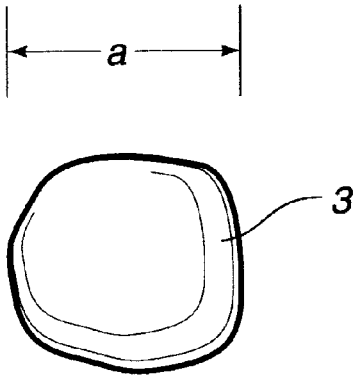
FIG. 8 is a plan view of a grain of sand.

Sand is either natural sand (river sand, sea sand or pit sand) or manufactured sand obtained by grinding stones. Grains of sand are particles having a diameter (See the reference symbol "a" in FIG. 8.) of 0.1 to 2 mm and various shapes. Grains of sand have rough surfaces.

Alternatively, nonspherical particles 3' having rough surfaces may be rollably disposed between the upper foundation 1*a* and the lower foundation 1*b*, the nonspherical particles 3' supporting the weight of the building including the upper foundation 1*a*. The nonspherical particles 3' having rough surfaces may be particles of glass, ceramics or plastic, for example. The nonspherical particles 3' have the same diameter as sand 3.

Figure 7:
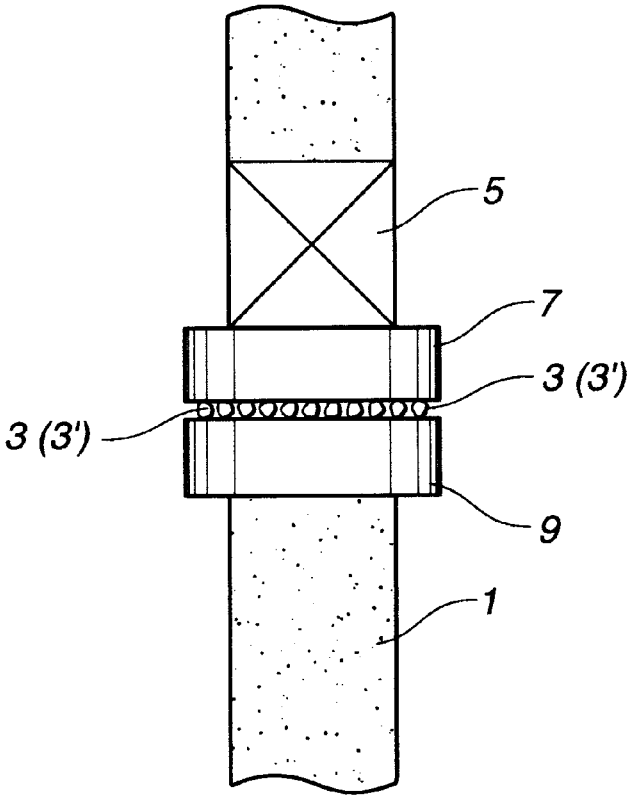
FIG. 7 is a side view showing a further example of the device.

In an embodiment shown in FIG. 7, grains of sand 3 are rollably disposed between a groundsill 5 of the building and a foundation 1 of the building, the grains of sand 3 supporting the weight of the building including the groundsill 5.

Alternatively, nonspherical particles 3' having rough surfaces may be rollably disposed between the groundsill 5 of the building and the foundation 1 of the building, the nonspherical particles 3' supporting the weight of the building including the groundsill 5.

The grains of sand 3 or the nonspherical particles 3' having rough surfaces are preferably placed between an elastic upper holding plate 7 and an elastic lower holding plate 9. The upper holding plate 7 is fixed to a lower surface of the upper foundation 1*a* or a lower surface of the groundsill 5. The lower holding plate 9 is fixed to an upper surface of the lower foundation 1*b* or an upper surface of the foundation 1. The elastic upper holding plate 7 and the elastic lower holding plate 9 are made of rubber, for example. The upper holding plate 7 and the lower holding plate 9 may have a circular or rectangular shape, for example, when seen from above.

Figure 1:
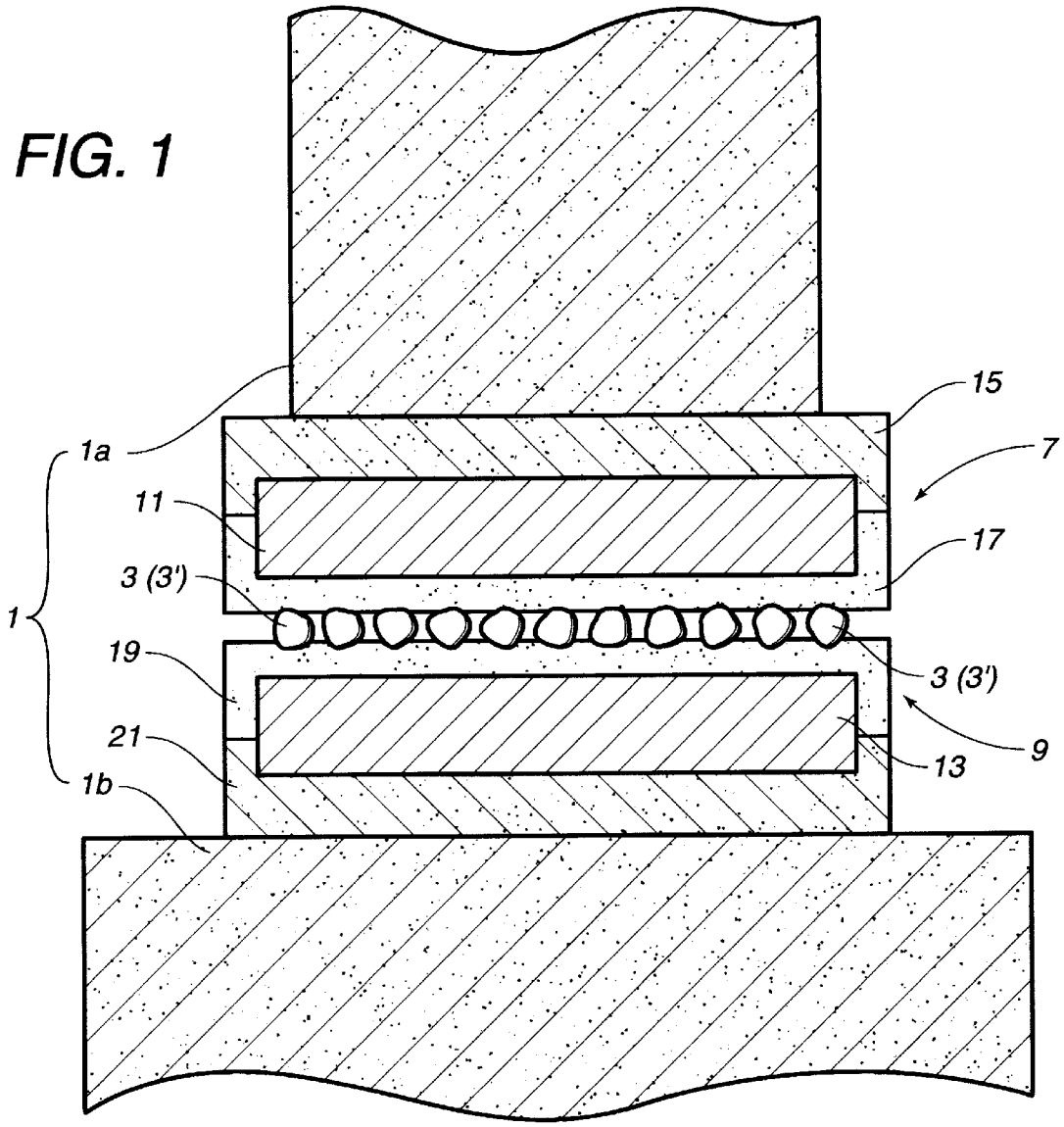
FIG. 1 is a sectional view showing an example of a device for minimizing earthquake shocks to a small building.

The upper holding plate 7 preferably has a rigid core 11 in the inside. The lower holding plate 9 preferably has a rigid core 13 in the inside. In FIG. 1, for example, the upper holding plate 7 comprises an upper elastic plate 15, a lower elastic plate 17 and the rigid core 11 disposed between the upper elastic plate 15 and the lower elastic plate 17. The lower holding plate 9 comprises an upper elastic plate 19, a lower elastic plate 21 and the rigid core 13 disposed between the upper elastic plate 19 and the lower elastic plate 21. The upper elastic plate 15 and the lower elastic plate 17 of the upper holding plate 7 are made of an elastic material such as rubber. Also, the upper elastic plate 19 and the lower elastic plate 21 of the lower holding plate 9 are made of an elastic material such as rubber.

Figure 2:
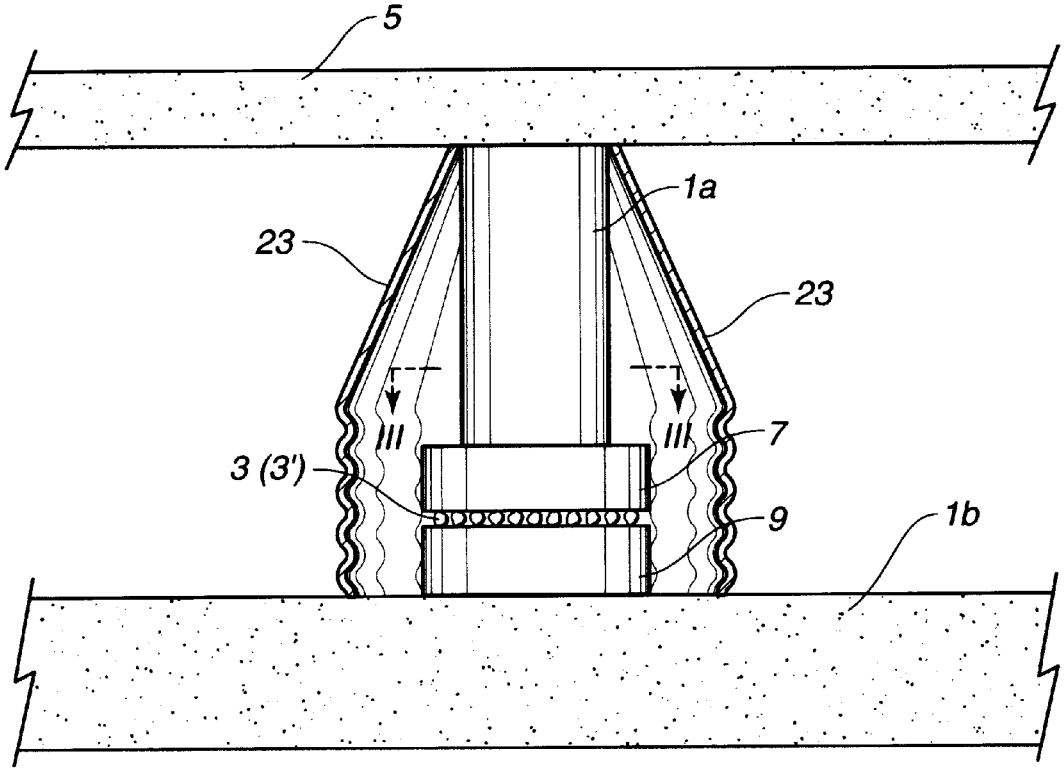
FIG. 2 is a side view showing another example of the device.
Figure 3:
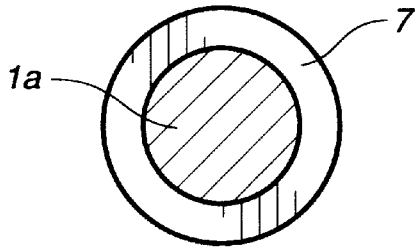
FIG. 3 is a sectional view taken along a line III—III of FIG. 2.
Figure 4:
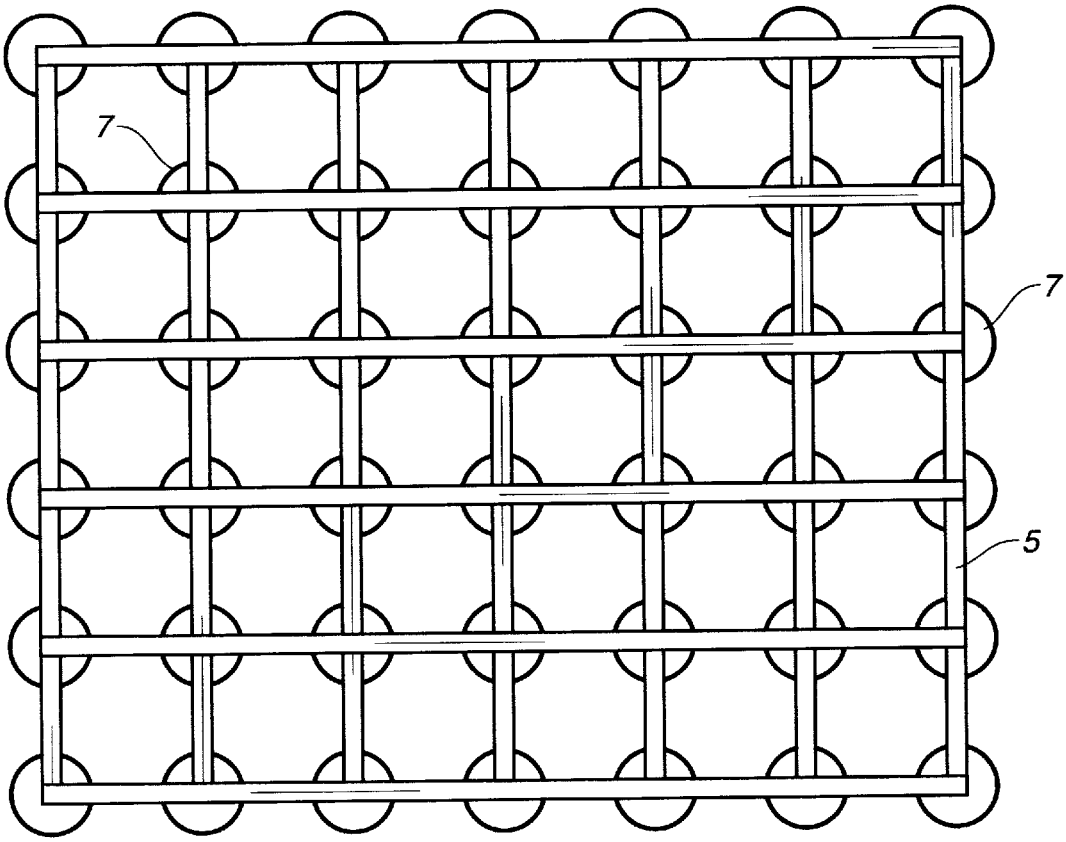
FIG. 4 is a plan view showing a case where the device is applied to a small building.

Reference symbol 23 in FIG. 2 represents a sheet for preventing the grains of sand 3 or the nonspherical particles 3' having rough surfaces from being scattered in the wind.

Figure 5:
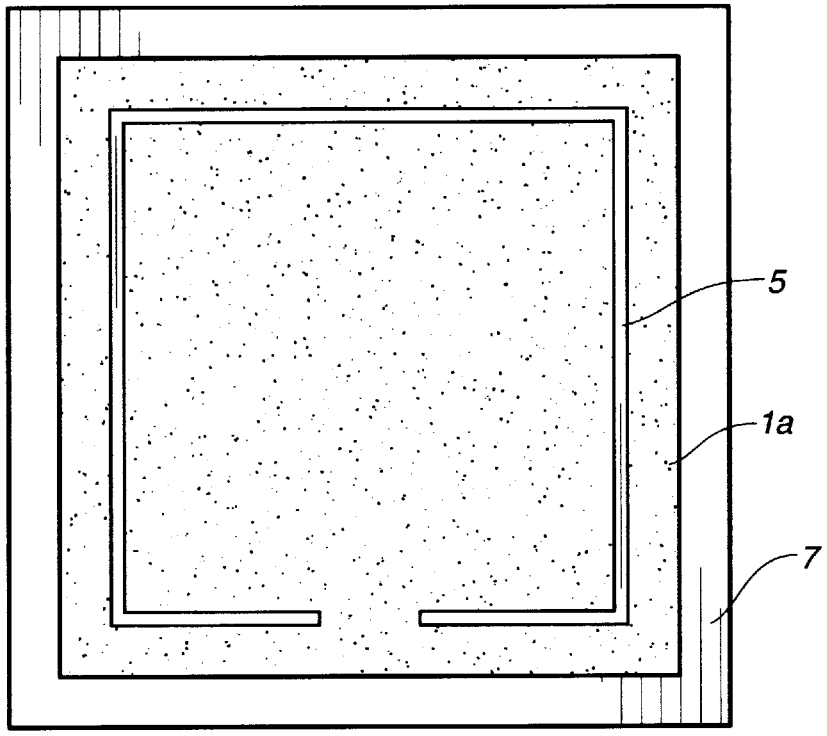
FIG. 5 is a plan view showing another case where the device is applied to a small building.
Figure 6:
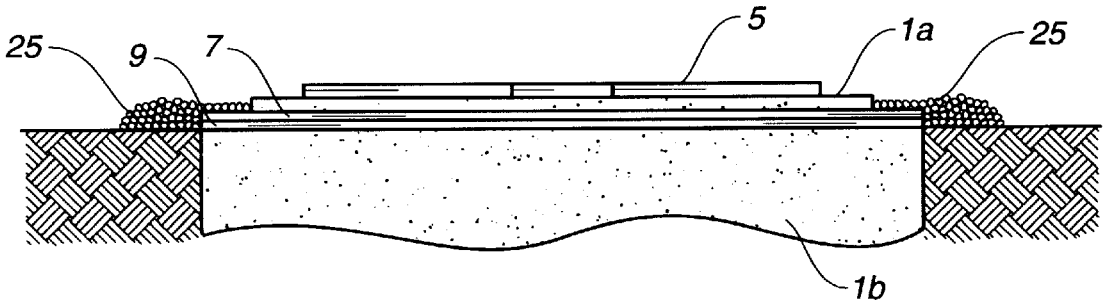
FIG. 6 is a sectional view of the device in FIG. 5.

FIGS. 5 and 6 show a device for minimizing earthquake shocks to a small building such as a small store and a small factory, the floor of which is almost at the same height as the ground level. In this example, a mat foundation 1 is divided into an upper foundation 1*a* and a lower foundation 1*b*. Grains of sand are rollably disposed between the upper foundation 1*a* and the lower foundation 1*b* through the intermediates of the upper holding plate 7 and the lower holding plate 9 shown in FIG. 1. The grains of sand support the weight of the building including the upper foundation 1*a*. When an earthquake happens, the upper foundation 1*a* is moved in a horizontal direction relatively to the lower foundation 1*b*. Therefore, a buffer zone 25 of gravel having a width larger than the maximum seismic amplitude is formed around the upper foundation 1*a*.

When the foundation of a building is divided into the upper foundation 1*a* and the lower foundation 1*b*, grains of sand 3 being rollably disposed between the upper foundation 1*a* and the lower foundation 1*b* through the intermediates of the upper holding plate 7 and the lower holding plate 9 shown in FIG. 1, the grains of sand 3 supporting the weight of the building including the upper foundation 1*a*, then both the coefficient of statical friction and the coefficient of dynamical friction between grains of sand 3 and the upper and lower holding plates 7 and 9 will be about 0.1 to 0.2, the vibration of the building being reduced to about 100 to 200 gal.

The present invention has the following advantages:

The grains of sand disposed between the upper foundation and the lower foundation do not roll when the building receives a small horizontal force of wind, etc. Therefore, the building including the upper foundation is not moved in a horizontal direction by a small force of wind. When the ground on which the lower foundation is fixed is shaken or trembled by an earthquake, the grains of sand rollably disposed between the upper foundation and the lower foundation are rolled so as to minimize horizontal shocks of the earthquake to the building including the upper foundation. Thus, the building is protected from the horizontal shocks of the earthquake. Since the grains of sand are inexpensive, it is possible to provide the device of the invention at a low price.

Since grains of sand have a moderately large coefficient of friction, a trigger device and a damping device may not be necessary. Since grains of sand are unlikely to roll, they can be easily held in place and do not need a precise holding means.

Since grains of sand withstand a large weight, it is possible to surely prevent a building from being moved by a wind pressure by increasing the weight per area of the building.

Grains of sand are weatherproof and change little with the passage of time. Grains of sand can be used for a long period of time.

The device in which grains of sand are rollably disposed between a groundsill of the building and a foundation of the building has the same advantages as above.

The device using the nonspherical particles having rough surfaces has the same advantages as the device using the grains of sand.

In the device in which the grains of sand or the nonspherical particles having rough surfaces are placed between the elastic upper holding plate and the elastic lower holding plate, the grains of sand or the nonspherical particles cut into the upper and lower holding plates according to the sizes and shapes thereof. Therefore, each grain of sand or each nonspherical particle withstands a larger weight. Even if the grains of sand or the nonspherical particles have different sizes and shapes, the weight of the building is supported by almost all of the grains of sand or the nonspherical particles. Therefore, the grains of sand or the nonspherical particles can bear a larger load.

Since the grains of sand or the nonspherical particles cut into the upper and lower holding plates, the grains of sand or the nonspherical particles are likely to roll and unlikely to slide between the upper and lower holding plates. Therefore, the coefficient of friction between the grains of sand or the nonspherical particles and the upper and lower holding plates is relatively small, and the difference between the coefficient of statical friction and the coefficient of dynamical friction is small.

As a result, the building is not moved in a horizontal direction by a small horizontal force of wind, etc., and horizontal shocks of the earthquake are not transmitted to the building. Thus, the building is more effectively protected from the horizontal shocks of the earthquake.

In the device in which the elastic upper holding plate and the elastic lower holding plate respectively have a rigid core in the inside, portions of each holding plate above and below the rigid core have elasticity. Therefore, even if the lower surface of the upper foundation or the groundsill or the upper surface of the lower foundation or the foundation is not precisely finished, all portions of each rigid core receive a uniform force. Also, a portion of the upper holding plate below the rigid core thereof and a portion of the lower holding plate above the rigid core thereof, both of which portions contact the grains of sand or the nonspherical particles, are kept flat. As a result, the grains of sand or the nonspherical particles receive a uniform force and function uniformly.

As many apparently widely different embodiments of the present invention may be made without departing from the spirit and scope thereof, it is to be understood that the invention is not limited to the specific embodiments thereof except as defined in the appended claims.

What is claimed is:

1. A device for minimizing earthquake shocks comprising:

a building having a foundation divided into an upper foundation and a lower foundation; and grains of sand rollably disposed between said upper foundation and said lower foundation, said grains of sand supporting a weight of said building including said upper foundation, said grains of sand positioned between an elastic upper holding plate and an elastic lower holding plate, said upper holding plate being fixed to a lower surface of said upper foundation, said lower holding plate being fixed to an upper surface of said lower foundation, said upper holding plate and said lower holding plate respectively having a rigid core in an interior thereof.

2. A device for minimizing earthquake shocks comprising:

a building having a foundation divided into an upper foundation and a lower foundation; and nonspherical particles having rough surfaces rollably disposed between said upper foundation and said lower foundation, said nonspherical particles supporting a weight of said building including said upper foundation, said nonspherical particles being positioned between an elastic upper holding plate and an elastic lower holding plate said upper holding plate, being fixed to a lower surface of said upper foundation, said lower holding plate being fixed to an upper surface of said lower foundation, said upper holding plate and said lower holding plate respectively having a rigid core in an interior thereof.

3. A device for minimizing earthquake shocks comprising:

a building having a groundsill and a foundation; and grains of sand rollably disposed between said groundsill and said foundation, said grains of sand supporting a weight of said building including said groundsill, said grains of sand having rough surfaces, said grains of sand positioned between an elastic upper holding plate and an elastic lower holding plate, said upper holding plate being fixed to a lower surface of said groundsill, said lower holding plate being fixed to an upper surface of said foundation, said upper holding plate and said lower holding plate respectively having a rigid core in an interior thereof.

4. A device for minimizing earthquake shocks comprising:

a building having a groundsill and a foundation; and nonspherical particles having rough surfaces, said nonspherical particles being rollably disposed between said groundsill and said foundation, said nonspherical particles supporting a weight of said building including said groundsill, said nonspherical particles positioned between an elastic upper holding plate and an elastic lower holding plate, said upper holding plate being fixed to a lower surface of said groundsill, said lower holding plate being fixed to an upper surface of said foundation, said upper holding plate and said lower holding plate respectively having a rigid core in an interior thereof.

* * * * *